US007990807B2

(12) United States Patent
Li et al.

(10) Patent No.: US 7,990,807 B2
(45) Date of Patent: Aug. 2, 2011

(54) ELECTRONIC DEVICE WITH AN ALARM CLOCK FUNCTION AND METHOD OF CONTROLLING THE FUNCTION

(75) Inventors: Xiao-Guang Li, Shenzhen (CN); Hung-Tai Hsu, Taipei Hsien (TW); Chung-Jen Lan, Taipei Hsien (TW); Kuan-Hong Hsieh, Taipei Hsien (TW)

(73) Assignees: Hong Fu Jin Precision Industry (ShenZhen) Co., Ltd., Shenzhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 288 days.

(21) Appl. No.: 12/186,527

(22) Filed: Aug. 6, 2008

(65) Prior Publication Data

US 2009/0059733 A1 Mar. 5, 2009

(30) Foreign Application Priority Data

Aug. 31, 2007 (CN) ..... 2007 1 0076760

(51) Int. Cl.
*G04C 21/00* (2006.01)
*G04B 23/00* (2006.01)

(52) U.S. Cl. ..... 368/73; 368/262

(58) Field of Classification Search ..... 368/12, 368/72–74, 250, 262–263
See application file for complete search history.

(56) References Cited

U.S. PATENT DOCUMENTS

| | | | | | |
|---|---|---|---|---|---|
| 4,316,273 | A * | 2/1982 | Jetter | 368/47 |
| 4,426,157 | A * | 1/1984 | Jetter | 368/73 |
| 4,430,006 | A * | 2/1984 | Jetter | 368/73 |
| 5,095,468 | A * | 3/1992 | Sato | 368/72 |
| 5,189,648 | A * | 2/1993 | Cooper et al. | 368/73 |
| 5,926,442 | A * | 7/1999 | Sirhan et al. | 368/73 |
| 2004/0013042 | A1 * | 1/2004 | Farine | 368/10 |
| 2007/0285396 | A1 * | 12/2007 | Fu | 345/169 |
| 2008/0084319 | A1 * | 4/2008 | Fan | 340/575 |
| 2009/0010108 | A1 * | 1/2009 | Li et al. | 368/73 |
| 2009/0046541 | A1 * | 2/2009 | Chou et al. | 368/262 |
| 2009/0086585 | A1 * | 4/2009 | Chou et al. | 368/274 |

* cited by examiner

*Primary Examiner* — Vit W Miska
(74) *Attorney, Agent, or Firm* — Zhigang Ma

(57) ABSTRACT

An electronic device with an alarm clock function includes a storage unit storing at least one icon; a display unit including a plurality of display areas; an input unit including a plurality of input parts each of which corresponds to one of the display areas; a managing unit for enabling or disabling an alarm clock function; an area selection module for randomly selecting one of the display areas and outputting the icon on the selected display area; and a comparison module for determining whether the input part pressed by a user matches the selected display area. A method for controlling the alarm clock function is also provided.

13 Claims, 4 Drawing Sheets

ELECTRONIC DEVICE WITH AN ALARM CLOCK FUNCTION AND METHOD OF CONTROLLING THE FUNCTION

BACKGROUND

1. Technical Field

The present invention relates to an electronic device with an alarm clock function that can effectively wake-up a user.

2. General Background

Waking up in the morning or simply being on time is a difficult proposition for many people. It is quite common for people to use alarm clocks to wake or alert themselves at a pre-determined time. A user can press a particular or any key to turn off the alarm clock. Unfortunately, the user may inadvertently turn off the alarm when he or she is groggy from waking up. This sometimes leads to oversleeping. Moreover, the user may not realize he or she has turned off the alarm.

To counteract this problem, some people use what is commonly known as a snooze function, however people may disable this function as well without fully awakening. If the alarm clock can be turned off only when the user is clear-headed, that would be more effective.

Therefore, an alarm clock function that can wake the user up effectively is needed.

SUMMARY

An electronic device with an alarm clock function includes a storage unit storing at least one icon; a display unit including a plurality of display areas; an input unit including a plurality of input parts each of which corresponds to one of the display areas; a managing unit for enabling or disabling an alarm clock function; an area selection module for randomly selecting one of the display areas and outputting the icon on the selected display area; and a comparison module for determining whether the input part pressed by a user matches the selected display area. A method for controlling the alarm clock function is also provided.

Other advantages and novel features will be drawn from the following detailed description with reference to the attached drawings.

BRIEF DESCRIPTION OF THE DRAWINGS

The components of the drawings are not necessarily drawn to scale, the emphasis instead being placed upon clearly illustrating the principles of the electronic device with an alarm clock function that can effectively wake-up a user. Moreover, in the drawings, like reference numerals designate corresponding parts throughout the several views.

DETAILED DESCRIPTION OF THE EMBODIMENT

Figure 1:
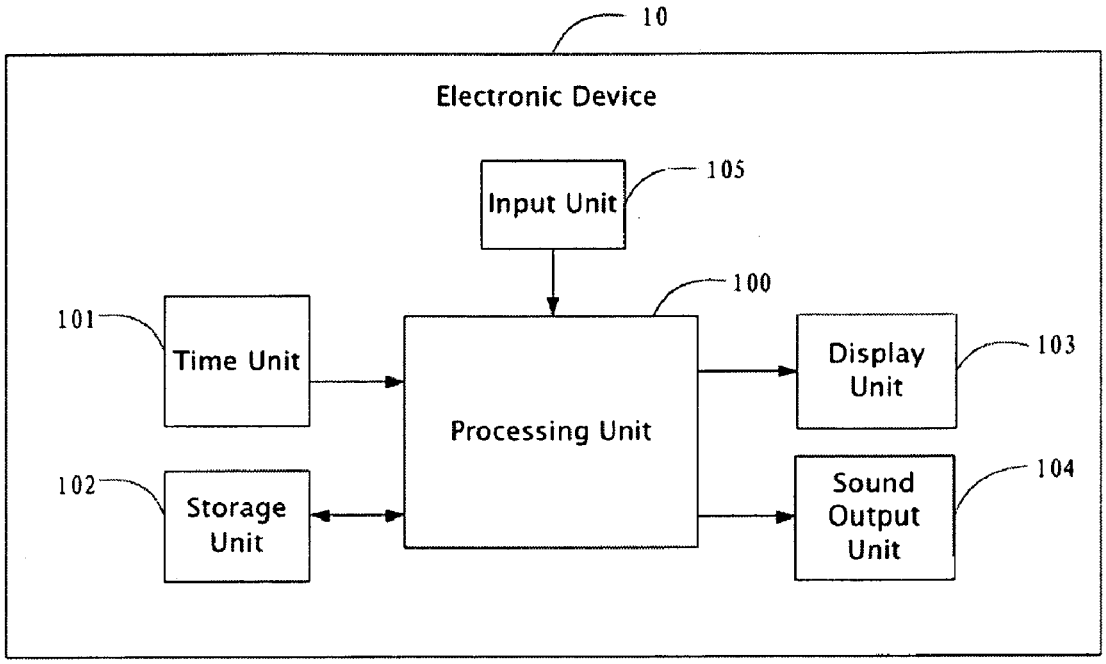
FIG. 1 is an exemplary block diagram of a hardware infrastructure of an electronic device with an alarm clock function in accordance with an exemplary embodiment of the invention.

FIG. 1 is an exemplary block diagram of a hardware infrastructure of an electronic device with an alarm clock function in accordance with an exemplary embodiment of the invention. The electronic device 10 includes a processing unit 100, a time unit 101, a storage unit 102, a display unit 103, a sound output unit 104, and an input unit 105.

The time unit 101 is used for supplying the current time. The display unit 103 and the sound output unit 104 are used for outputting video or sound information according to an instruction of the processing unit 100. The storage unit 102 is used for storing an alarm time, alarm modes, at least one icon, a preset number, and a count number. The alarm modes include, but are not limited to, a ring mode and a vibration mode. The count number represents a count of a user's correct inputs. The alarm time is set by the user and indicates a time of enabling an alarm clock function. The preset number indicates the number of times that the user must input a correct answer. When the count number matches the preset number, the alarm clock function is disabled.

Figure 2:
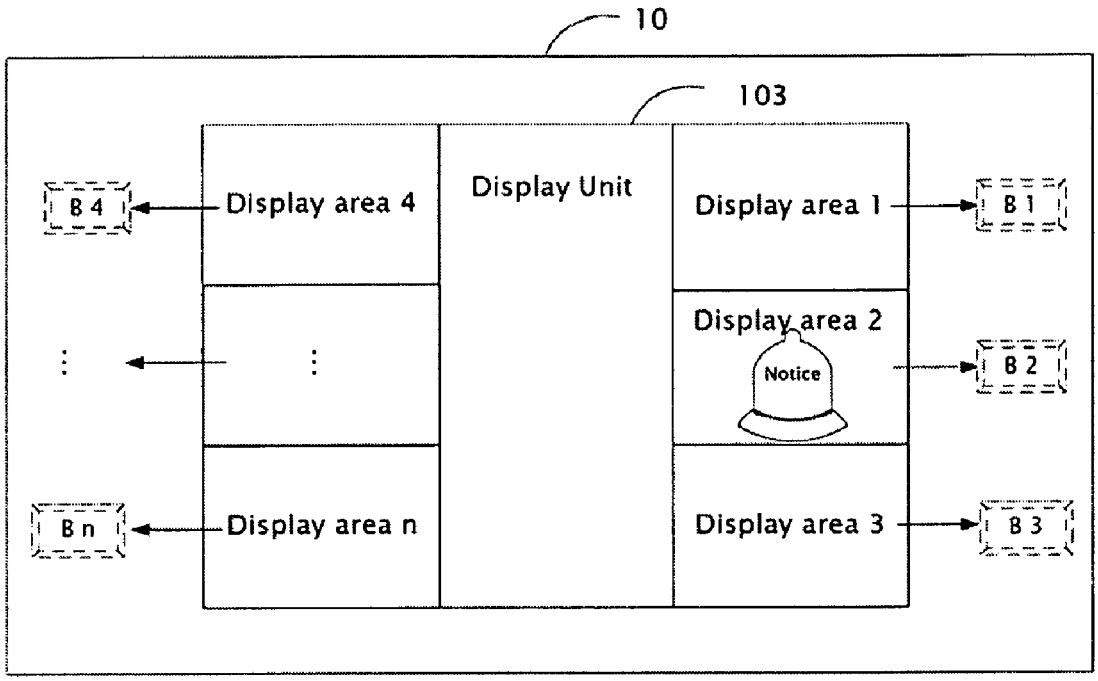
FIG. 2 is a schematic diagram showing a display interface provided by a display unit of the electronic device of FIG. 1 in accordance with the exemplary embodiment of the invention.

The display unit 103 includes a plurality of display areas, and the input unit 105 includes a plurality of input parts for receiving a user's input (shown in FIG. 2). The display unit 103 can be a liquid crystal display (LCD), or a touch sensitive screen. In a first exemplary embodiment, the touch sensitive screen is employed as the display unit 103. Consequently, the display unit 103 also serves as the input unit 105, and the display areas thereof serve as the input sections. In a second exemplary embodiment, the LCD is employed as the display unit 103. The storage unit 102 further stores a table. The table includes one column of the display areas and one column of the input parts. The selected display area of the display unit 103 is used for displaying the icon.

FIG. 2 is a schematic diagram showing a display interface provided by the display unit 103 in accordance with an exemplary embodiment. The display unit 103 provides a plurality of display areas, e.g. a display area 1, a display area 2, a display area 3, and so on. Each display area is configured for displaying an icon, as shown in the display area 2 in FIG. 2 for example. Each of the display areas is associated with one input part of the input unit 105. For example, as shown in FIG. 2, the display area 1 corresponds to a key B1, the display area 2 corresponds to a key B2, the display area 3 corresponds to a key B3, and so on.

When the alarm clock function is enabled, the processing unit 110 randomly selects one of the display areas, and outputs an icon on the selected display area. The processing unit 100 receives input from the user and determines whether the input part pressed by the user matches the selected display area. When the input part pressed by the user matches the selected display area, the processing unit 100 adds 1 to the count number, and determines whether the count number is equal to the preset number. If the count number is equal to the preset number, the processing unit 100 disables the alarm clock function. If the count number is less than the preset number, the processing unit 100 selects another display area on the display unit 103, and outputs an icon on the selected display area.

Figure 3:
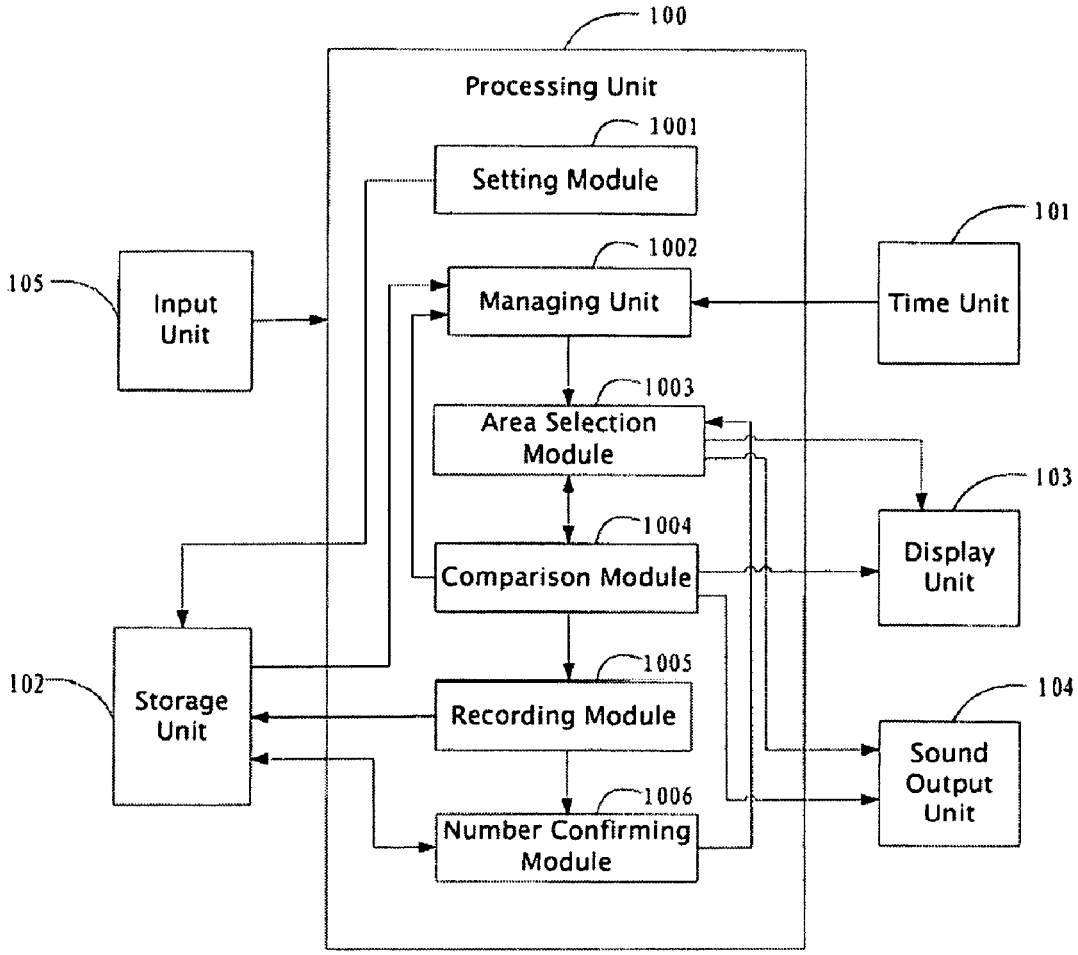
FIG. 3 is an exemplary block diagram of main function modules of a processing unit of the electronic device of FIG. 1.

FIG. 3 is an exemplary block diagram of main function modules of the processing unit 100. The processing unit 100 includes a setting module 1001, a managing unit 1002, an area selection module 1003, a comparison module 1004, a recording module 1005, and a number confirming module 1006. The functions of the modules in the processing unit 100 are described below together with FIG. 4.

Figure 4:
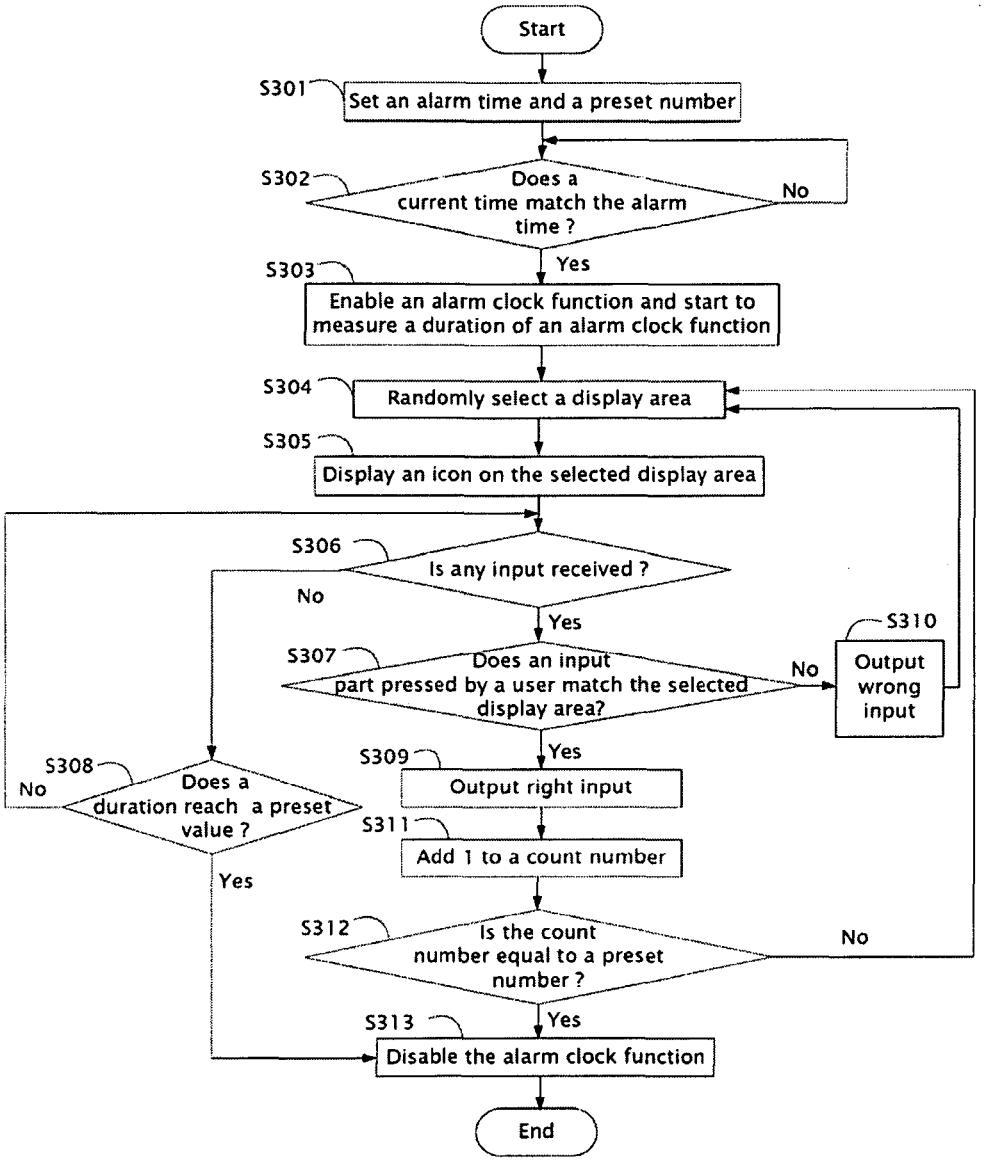
FIG. 4 is a flowchart of a method of controlling the alarm clock function implemented by the electronic device of FIG. 1 in accordance with an exemplary embodiment of the invention.

FIG. 4 is a flowchart of a method of controlling the alarm clock function implemented by the electronic device 100 in accordance with an exemplary embodiment.

In step S301, the setting module 1001 sets the alarm time, the alarm mode, and the preset number, via the input unit 105, and stores these settings in the storage unit 102 according to the input of a user. However, the alarm mode and the preset number can also be pre-stored in the storage unit 102 without setting.

In step S302, the managing unit 1002 periodically obtains the current time from the time unit 101, and determines whether the current time matches the alarm time. If the current time does not match the alarm time, the managing unit 1002 repeats step S302.

When the current time is the alarm time, in step S303, the managing unit 1002 obtains the alarm mode from the storage unit 102, enables the alarm clock function, and informs the time unit 101 to start measuring a duration of the alarm clock function.

In step S304, the managing unit 1002 sends a selecting signal to the area selection module 1003, and the area selection module 1003 randomly selects one of the display areas according to the selecting signal.

In step S305, the area selection module 1003 outputs the icon on the selected display area.

In step S306, the comparison module 1004 detects whether the input is received from the input unit 105.

In step S307, if the input is received from the input unit 105, the comparison module 1004 determines whether the input part pressed by the user matches the selected display area.

If no input is received from the input unit 105, in step S308, the comparison module 1004 determines whether the duration of the alarm clock function equals a preset value. If the duration of the alarm clock function is less than the preset value, the procedure returns to step S306. If the duration of the alarm clock is equal to the preset value, the procedure goes to step S313 described below.

If the input part pressed by the user matches the selected display area in step S309, the comparison module 1004 outputs a first result, such as "right input", via the display unit 103 or sound output unit 104, and sends a determining signal to the recording module 1005, and the procedure goes to step S311.

If the input part pressed by the user does not match the selected display area, in step S310, the comparison module 1004 outputs a second result, such as "wrong input", via the display unit 103 or sound output unit 104, and the procedure returns to step S304.

In step S311, the recording module 1005 adds 1 to the count number according to the determining signal.

In step S312, the number confirming module 1006 determines whether the count number is equal to the preset number. If the count number is not equal to the preset number, the procedure returns to step S304.

If the count number is equal to the preset number, in step S313, the managing unit 1002 disables the alarm clock function, and resets the count number.

In addition, in another embodiments of the invention, in step S310, if the input part pressed by the user does not match the selected display area, the comparison module 1004 outputs the second result via the display unit 103 or sound output unit 104, and the procedure returns to step S306, but not to step S304.

Although the present invention has been specifically described on the basis of an exemplary embodiment thereof, the invention is not to be construed as being limited thereto. Various changes or modifications may be made to the embodiment without departing from the scope and spirit of the invention.

What is claimed is:

1. An electronic device with an alarm clock function, the electronic device comprising:

a storage unit storing at least one icon, a preset number, and a count number for indicating correct inputted counts;

a display unit comprising a plurality of display areas;

an input unit comprising a plurality of input parts each of which corresponds to one of the display areas;

a managing unit for enabling or disabling an alarm clock function;

an area selection module for randomly selecting one of the display areas and outputting the icon on the selected display area; and a comparison module for determining whether the input part pressed by a user matches the selected display area;

a recording module for updating the count number;

a number confirming module for determining whether the count number is equal to the preset number;

wherein when one of the plurality of input parts pressed by the user matches the selected display area, the recording module adds one to the count number; when the count number reaches the preset number, the managing unit disables the alarm clock function, and when the count number does not reach the preset number, the area selection module random re-selects one display area from the display unit and outputs the icon on the selected display area.

2. The electronic device as described in claim 1, wherein when the input part pressed by the user does not match the selected display area, the area selection module random re-selects one display area from the display unit and outputs the icon on the selected display area.

3. The electronic device as described in claim 1, wherein when the input part pressed by the user does not match the selected display area, the comparison module receives the input and determines whether the input part pressed by a user matches the selected display area.

4. The electronic device as described in claim 1, wherein the input parts are keys.

5. The electronic device as described in claim 1, wherein the input parts are touch-sensing parts.

6. A method of controlling an alarm clock function comprising:

supplying a display unit comprising a plurality of display areas, an input unit comprising a plurality of input parts each of which corresponds to one of the input parts, and a storage unit storing at least one icon, a preset number and a count number for indicating counts that the user inputs correctly;

enabling an alarm clock function;

randomly selecting one of the display areas and outputting the icon on the selected display area;

determining whether the input part pressed by a user matches the selected display area;

adding one to the count number when the input part pressed by the user matches the selected display area; and determining whether the count number is equal to the preset number;

wherein when the count number reaches the preset number, disabling the alarm clock function, and when the count number does not reach the preset number, re-selecting one display area from the display unit and outputting the icon on the selected display area.

7. The method as described in claim 6, wherein the method further comprises:

re-selecting one display area from the display unit and outputting the icon on the selected display area, when the input part pressed by a user does not match the selected display area.

8. The method as described in claim 6, wherein the method further comprises:

receiving the input and determining whether the input part pressed by a user matches the selected display area, when the input part pressed by a user does not match the selected display area.

9. The method as described in claim 6, wherein the input parts are keys.

10. The method as described in claim 6, wherein the input parts are touch-sensing parts.

11. An electronic device with an alarm clock function, the electronic device comprising:

a storage unit storing at least one icon, a preset number and a count number for indicating counts that the user inputs correctly;

a display unit comprising a plurality of display areas;

an input unit comprising a plurality of input parts each of which corresponds to one of the display areas;

a managing unit for enabling or disabling an alarm clock function;

an area selection module for randomly selecting one of the display areas and outputting the icon on the selected display area; and a comparison module for determining whether the input part pressed by a user matches the selected display area;

a recording module for updating the count number;

a number confirming module for determining whether the count number is equal to the preset number;

wherein when the input part pressed by the user matches the selected display area, the recording module adds one to the count number, when one of the plurality of input parts pressed by the user does not match the selected display area, the area selection module random re-selects one display area from the display unit and outputs the icon on the re-selected display area, when the count number reaches the preset number, the managing unit disables the alarm clock function.

12. The electronic device as described in claim 11, wherein the input parts are keys.

13. The electronic device as described in claim 11, wherein the input parts are touch-sensing parts.

* * * * *